US006742812B2

(12) United States Patent
Ramella et al.

(10) Patent No.: US 6,742,812 B2
(45) Date of Patent: Jun. 1, 2004

(54) MENU BOOK AND METHOD FOR ITS MANUFACTURE

(76) Inventors: Gerard M. Ramella, 1355 Kingsway, Westlake, OH (US) 44145; Thomas M. Ramella, 5 Westhampton, Rocky River, OH (US) 44116

( * ) Notice: Subject to any disclaimer, the term of this patent is extended or adjusted under 35 U.S.C. 154(b) by 138 days.

(21) Appl. No.: 10/081,253

(22) Filed: Feb. 22, 2002

(65) Prior Publication Data

US 2003/0160443 A1 Aug. 28, 2003

(51) Int. Cl.[7] ..... B42D 15/00

(52) U.S. Cl. ..... 283/67; 283/63.1; 283/61; 402/79; 281/38; 412/6; 412/902

(58) Field of Search ..... 281/2, 5, 38; 402/79, 402/80 R, 4; 283/61, 62, 63.1; 412/8, 6, 902

(56) References Cited

U.S. PATENT DOCUMENTS 4,640,030 A * 2/1987 Wood et al. ..... 40/746
5,425,555 A * 6/1995 Beange ..... 283/107
5,791,802 A 8/1998 Englum
5,904,373 A * 5/1999 Krapf ..... 281/29
6,196,750 B1 * 3/2001 Hansen ..... 402/79

* cited by examiner

*Primary Examiner*—Willmon Fridie, Jr.
(74) *Attorney, Agent, or Firm*—Rankin, Hill, Porter & Clark LLP

(57) ABSTRACT

A menu book includes a plurality of pages having transparent sleeves into which menu sheets can be inserted. A flexible, heat-sealable flange extends along a selected edge of each page. The pages are superimposed with the flanges being disposed adjacent each other. The flanges are heat-sealed together to bind the pages into a book. Preferably, the pages and flanges are made of textured vinyl. A particularly desirable method for manufacturing the pages includes the steps of providing a first sheet of transparent heat-sealable material, providing a second sheet of transparent heat-sealable material, superimposing the first and second sheets, forming first and second laterally spaced pages by joining the first and second sheets to each other with heat-sealed seams, the seams of the first and second pages that are adjacent to each other being spaced to define a web therebetween. The method includes the steps of stacking similar sheets atop each other, folding the pages toward each other so that the webs are folded to form flanges, and heat-sealing the flanges together.

31 Claims, 6 Drawing Sheets

MENU BOOK AND METHOD FOR ITS MANUFACTURE

BACKGROUND OF THE INVENTION

1. Field of the Invention

The invention relates to menu books and, more particularly, to the manufacture of menu books with pages having transparent sleeves.

2. Description of the Prior Art

Typically, menus are printed on paper. In the case of multi-page menus, they often consist of large sheets that are printed on both sides and folded in the middle to form a pair of pages having printing on the front and back surfaces. Several of these printed and folded sheets can be assembled to form a book. In an alternative paper menu construction, individual menu sheets are stacked atop each other and bound together along one edge.

A problem with the referenced menu constructions is that the menu sheets are printed on paper. Because the sheets are made of paper, they can be torn, soiled, or otherwise degraded, in which case they must be replaced. While it is possible to protect the sheets by laminating them between sheets of a transparent plastic material, the lamination process is expensive. This increases the cost of replacing outdated menu sheets. Also, the lamination sheets usually are quite rigid and difficult to bind together to form a menu book.

In another type of menu construction exemplified by U.S. Pat. No. 5,791,802, individual paper menu sheets are inserted into transparent pockets or sleeves included as part of menu pages made of a plastic material. The assembled pages are bound together to form a menu book. In menu books of the type referred to, the pages are spiral-bound. That is, openings are formed along one edge of each page, the pages are stacked atop each other with the openings superimposed, and a spiral coil is threaded through the openings. The assembled pages thus form a menu book that can be turned page-by-page. Such a menu book does not have a separate front or back cover that encloses the assembled pages. Rather, the uppermost page performs a cover function by displaying a decorative and/or informative insert within its transparent sleeve.

An advantage of the foregoing construction is that individual menu sheets can be replaced easily as circumstances warrant. On the other hand, if it is desired to use individual menu sheets for a long period of time, such usage is possible because the pages are more durable than paper and protect the menu sheets that are inserted into the sleeves. An additional advantage of the referenced construction is that an even number or odd number of such pages can be provided, depending on the needs of the user.

Despite the advantages of spiral-bound menu books made of plastic pages having transparent sleeves, certain drawbacks remain. Manufacturing time is longer than desired because it is difficult to thread the spiral coil through the openings of the pages. Once assembled, the ends of the coil can pose problems such as snagging clothing. If the coil becomes unraveled, the pages will fall apart. The menu books cannot be stacked conveniently because the coils have a larger diameter than the thickness of the pages bound by the coils, which requires that the menu books be stacked with the coils alternating on opposite sides if a level stack is to be maintained. Further, If alternate stacking is not done, the coils can become tangled with each other, making it difficult to separate the menu books from each other.

Yet additional drawbacks relate to the construction of the pages themselves. Typically, the pages are made of two sheets of plastic material such as vinyl that are heat-sealed to each other about the perimeter with a standard solid heat seal rule. The vinyl material can be weaker at the seal. Accordingly, the solid rule seal can be a weak link to the page itself. Further, the pages lack structural integrity. Because the pages are limp, cardboard stiffeners often are added to the sleeves. The added bulk and weight of the stiffeners puts additional stress on the heal seals as well as the spiral coils. Consequently, the menu pages deteriorate at a faster rate than expected.

Desirably, a menu book with pages having transparent sleeves would be available that would avoid the drawbacks of spiral-bound menu books. Specifically, any such menu book would be easy to manufacture and would be capable of being stacked with like menu books without concern for the orientation of the menu books. Further, any such menu book would not snag on clothing, would have pages that could not separate from each other, and would be easy to remove from a stack of similar menu books. Hopefully, the pages of any such menu book would have more structural integrity than existing menu pages and would be more durable.

SUMMARY OF THE INVENTION

In response to the foregoing concerns, the present invention provides a new and improved menu book with pages having transparent sleeves and method for manufacturing the menu book. A menu book according to the invention includes a plurality of pages, each having one or more transparent sleeves into which menu sheets can be inserted. A flexible, heat-sealable flange extends along a selected edge of each page. A plurality of pages are superimposed with the flanges of the pages being superimposed and disposed adjacent each other. The flanges are joined together to bind the pages into a book. In the preferred embodiment, the pages are made entirely of sheets of textured vinyl that can be heat-sealed to form each page and which will permit the pages to be heat-sealed to each other. Also, if desired, a strip of decorative, heat-sealable reinforcing material can be wrapped about the flanges and fused to the flanges so as to provide reinforcement for the flanges.

Each page preferably is rectangular with a longer side and a shorter side, the flange projecting from the longer side. Each page comprises a first sheet and a second sheet, the first and second sheets being superimposed, the first and second sheets being joined by a generally U-shaped, heat-sealed seam. The flange is an integral portion of one or both of the first or second sheets and projects laterally from the heat-sealed seam. It is desirable to fuse the flanges and the peripheral seams with a segmented rule, to round the corners of the pages with a relatively large radius, and to fuse the corners with a solid rule. This construction provides enhanced structural integrity for the pages.

A method for manufacturing a menu book according to the invention comprises the steps of providing a plurality of pages having transparent sleeves into which menu sheets can be inserted and a flexible, heat-sealable flange that extends along a selected edge of each page; superimposing the pages with the flanges of the pages being superimposed and disposed adjacent each other; and joining the flanges together, preferably by heat-sealing. A preferred method for manufacturing the pages comprises the steps of providing a first sheet of transparent heat-sealable material; providing a second sheet of transparent heat-sealable material; superimposing the first and second sheets; and forming first and second laterally spaced ages having transparent sleeves into which sheets of printed material can be placed. The pages are formed by joining the first and second sheets to each other with heat-sealed peripheral seams having a segmented rule. The seams of the first and second pages that are adjacent to each other are sealed with a solid rule and are spaced to define a web therebetween. The method includes the steps of stacking similar pages atop each other, folding the pages toward each other so that the webs are folded and the pages are stacked atop each other, and heat-sealing the webs together.

The menu book according to the invention is easy to manufacture. Because it avoids the use of spiral binding coils, it is capable of being stacked with like menu books without concern for the orientation of the menu books. Further, the menu book according to the invention will not snag on clothing and is easy to remove from a stack of similar menu books. The pages of the menu book cannot become separated from each other. Because the preferred embodiment of the menu book according to the invention is made of textured vinyl, it is very durable. Due to the particular construction of the seams, the pages have good structural integrity and strength.

The foregoing and other features and advantages of the invention will be apparent from a review of the specification and the accompanying drawings.

DESCRIPTION OF THE PREFERRED EMBODIMENT

Figure 1:
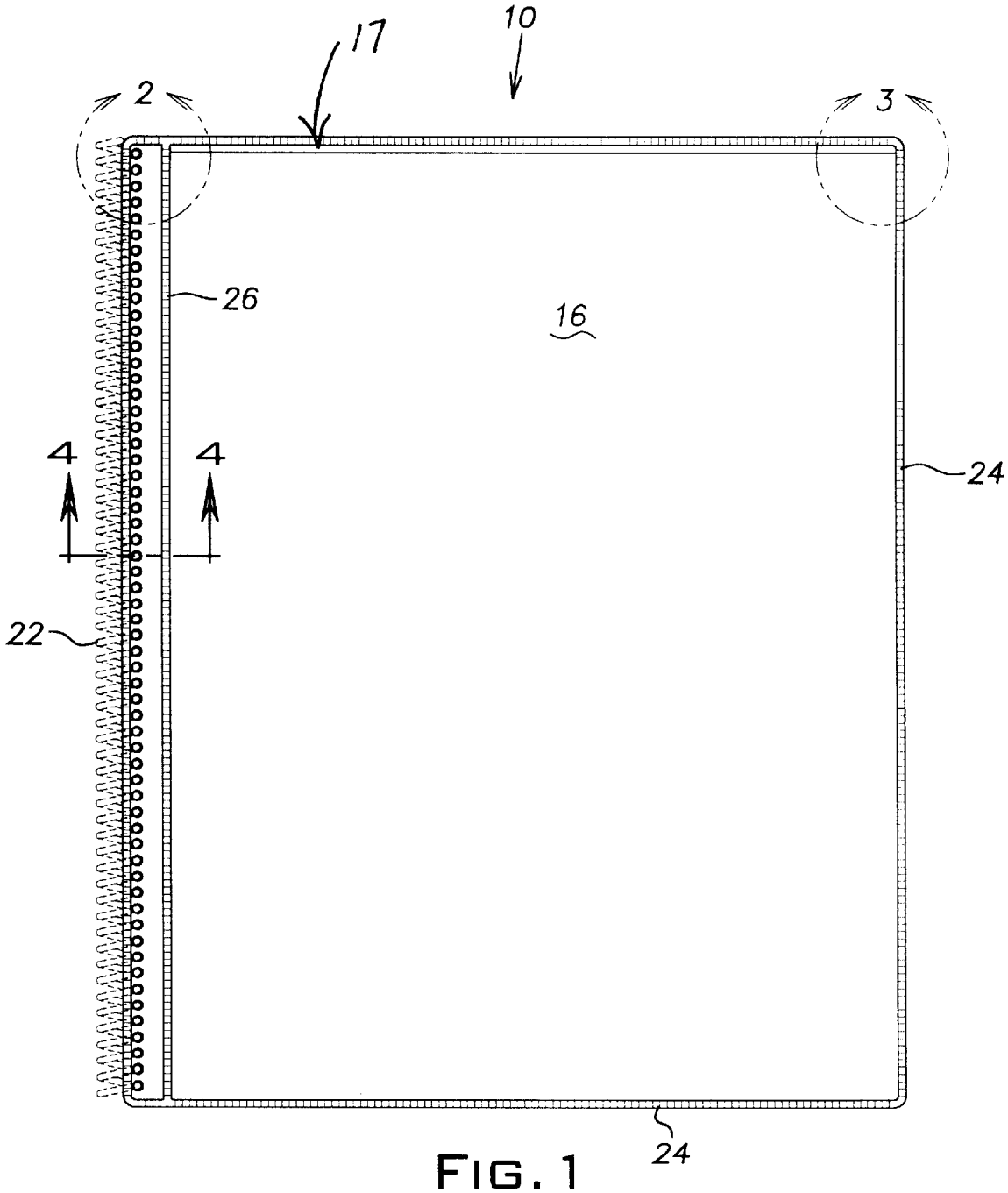
FIG. 1 PRIOR ART
FIG. 1 is a front elevation view of a page of a spiral-bound menu book according to the prior art.
Figure 2:
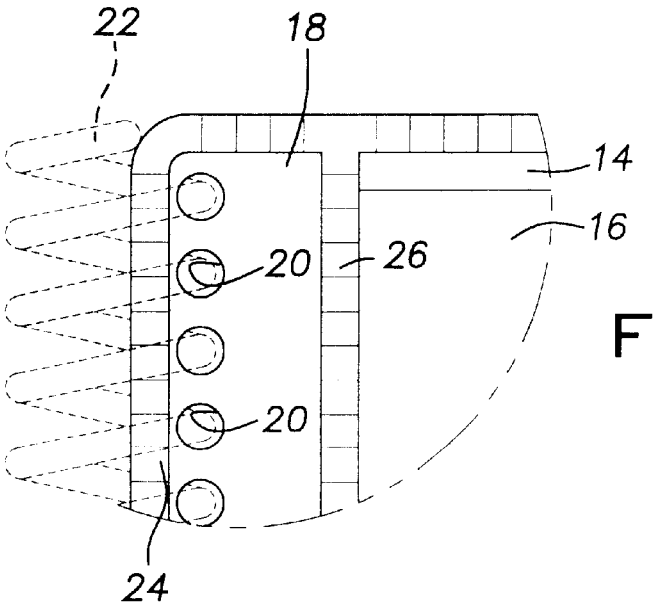
FIG. 2 is an enlarged view of a corner of the page of the menu book of FIG. 1 showing the construction of a coil-holding flange included as part of the page.
Figure 3:
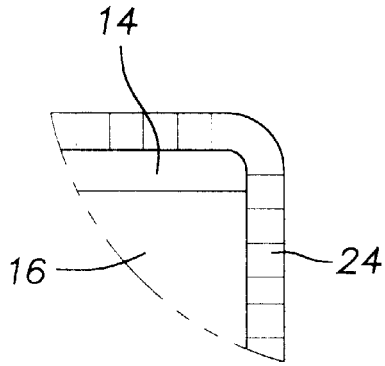
FIG. 3 is an enlarged view of a portion of FIG. 1 showing the construction of a corner of the page.
Figure 4:
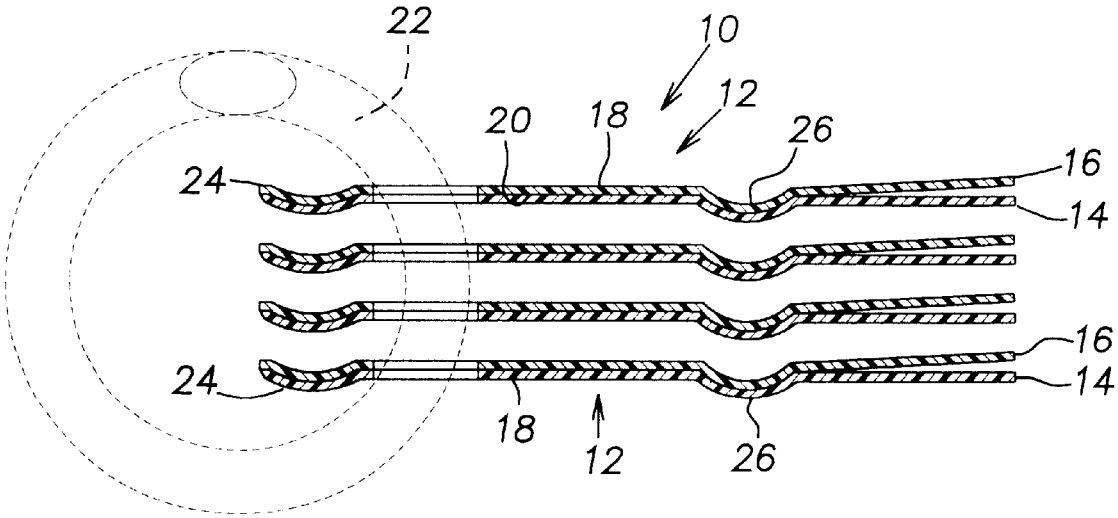
FIG. 4 is a view taken along a plane taken indicated by line 4—4 in FIG. 1.

Referring now to FIGS. 1–4, a spiral-bound menu book according to the prior art is indicated generally by the reference numeral 10. The menu book 10 includes a plurality of pages 12 each of which has a first, or back sheet 14 to which a second, or front sheet 16 is attached. The sheet 16 is shorter than the sheet 14 in order to make it easier to insert a menu sheet (not shown) into the sleeve 17, or pocket, defined by the sheets 14, 16.

A flange 18 extends along one edge of each page 12. The flange 18 has a plurality of openings 20 through which a spiral coil 22 is threaded. The sheets 14, 16 are heat-sealed to each other with solid rule seams 24 that extend about a portion of the periphery of the sheets 14, 16. Another solid rule seam 26 is spaced inwardly from one of the side seams and defines the flange 18.

Figure 5:
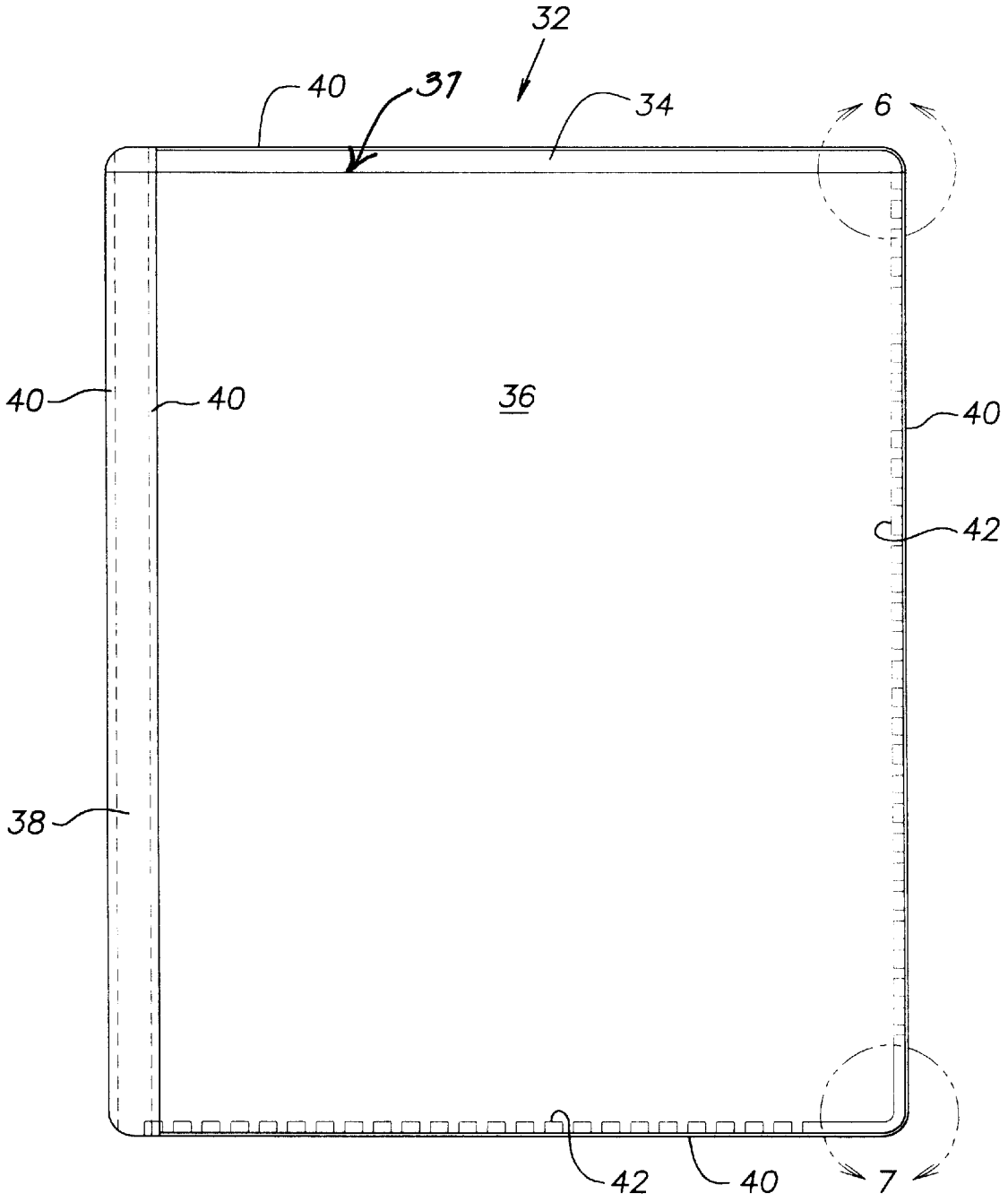
FIG. 5 is a front elevation view of a page of a menu book according to the invention in which a heat-sealable flange extends along one side edge.
Figure 6:
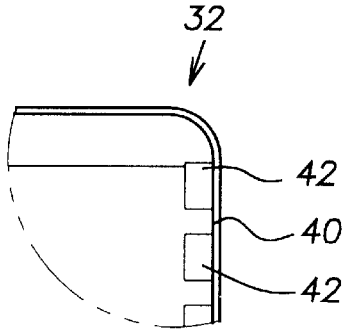
FIG. 6 is an enlarged view of one of the upper corners of the page of FIG. 5.
Figure 7:
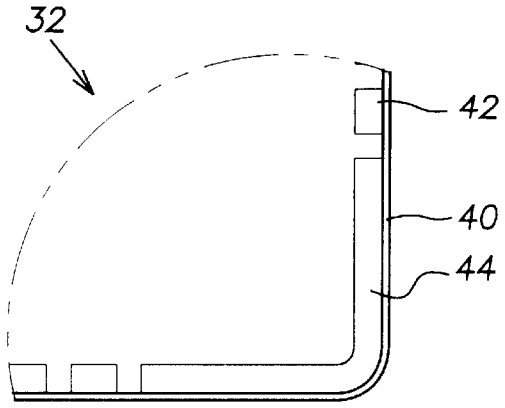
FIG. 7 is an enlarged view of the lower right-hand corner of the page of FIG. 5.

Referring now to FIGS. 5–7, a page for a menu book according to a first embodiment of the invention is indicated by the reference numeral 32. The page 32 is made of 10-gauge, transparent, textured vinyl sheets that are commercially available from the American Renolit Corporation of LaPorte, Ind. The page 32 has a first, or back sheet 34 and a second, or front sheet 36. The second sheet 36 is shorter than the first sheet 34 in order to facilitate placing a menu page within a pocket or sleeve 37 formed by the first and second sheets 34, 36.

Each page 32 includes a flange 38 that is disposed along one side edge. The sheets 34, 36 are die-cut and sealed about their periphery by a heat-sealed solid bar seal 40. In addition, a segmented bar seal 42 extends along the edge opposite the flange 38 and along the edge at the bottom of the page 32. As indicated in FIG. 7, each corner of the page 32 has a relatively large radius that is sealed by a large solid bar seal 44. A plurality of pages 32 can be stacked atop each other with the flanges 38 thereof being superimposed and adjacent to each other. Thereafter, the flanges 38 of the adjacent pages 32 can be heat-sealed to each other, as will be described in more detail below, to bind the pages 32 into a book.

Figure 8:
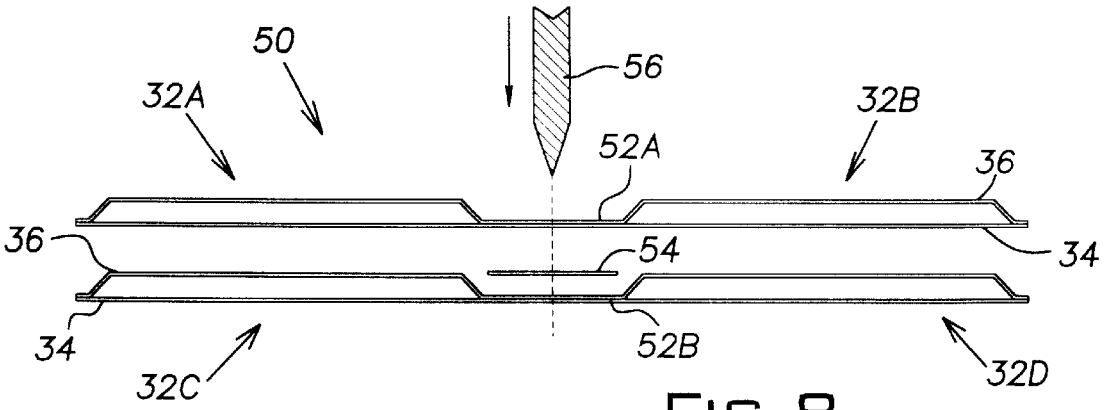
FIG. 8 is a schematic end view of web-connected pages according to the invention in the process of being joined to each other.
Figure 9:
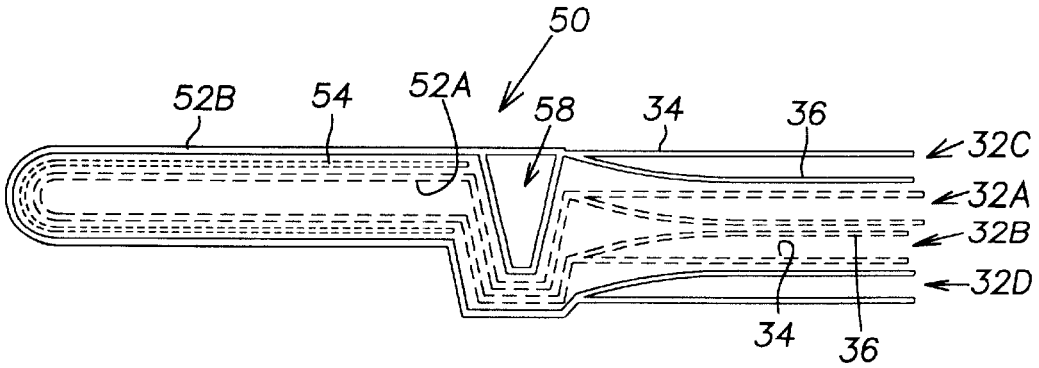
FIG. 9 is a cross-sectional view of a portion of an assembled menu book according to the invention.
Figure 10:
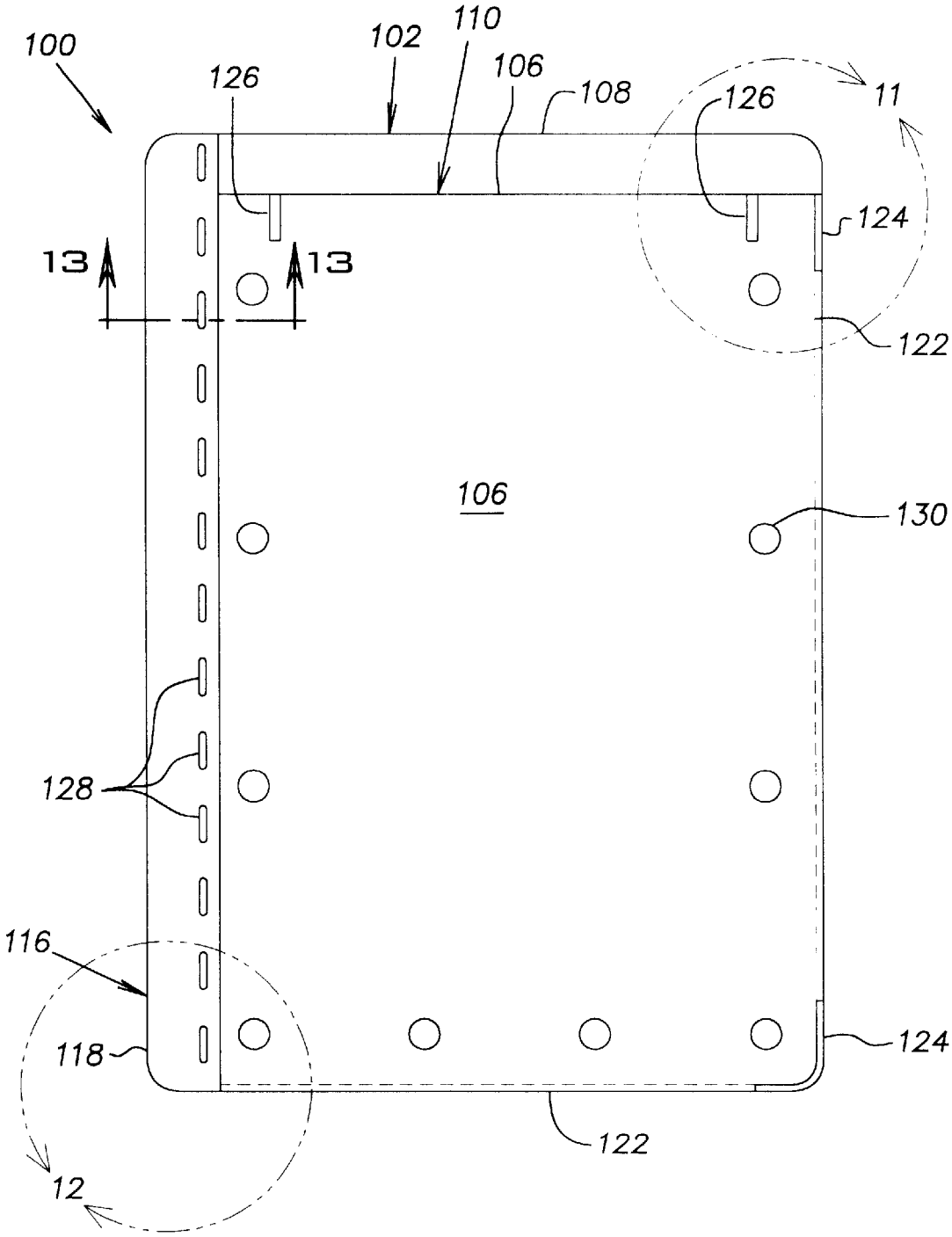
FIG. 10 is a front elevation view of another embodiment of a menu page in accordance with the invention.
Figure 11:
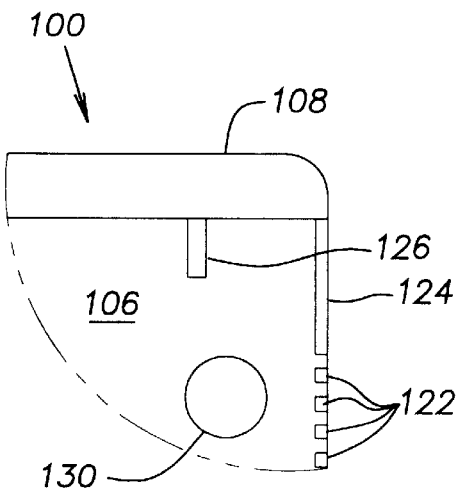
FIG. 11 is an enlarged view of one of the upper corners of the page of FIG. 10.
Figure 12:
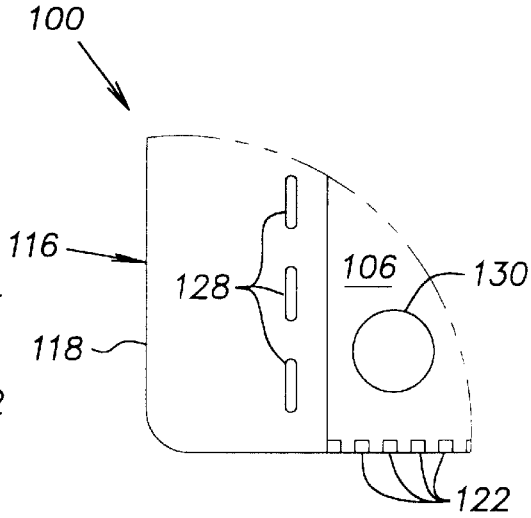
FIG. 12 is an enlarged view of the lower left-hand corner of the page of FIG. 10.

Referring now to FIGS. 8 and 9, a technique for manufacturing a menu book 50 according to another embodiment of the invention is shown. In FIG. 8, four pages 32A, 32B, 32C, and 32D are shown. Pages 32A and 32B are disposed adjacent to each other and are connected by a web 52A. Similarly, the pages 32C and 32D are laterally adjacent to each other and are connected by a web 52B. The preferred technique for forming the pages 32A, 32B and the pages 32C, 32D is to provide a first sheet 34 over which a smaller second sheet 36 is superimposed. The sheet 34 typically has exterior dimensions of about 11.625 inches (29.5 cm) high and 18.875 inches (47.9 cm) wide. The sheet 36 typically has exterior dimensions of about 11.375 inches (28.8 cm) high and 18.875 inches (47.9 cm) wide. The difference in height between the sheets 34, 36 provides a lip of 0.25 inch (0.63 cm) for the sleeve 37.

The sheets 34, 36 are joined to each other about their periphery with a bar seal. Two 0.0625 inch (0.15 cm) elongate bar seals are formed on either side of the center of the sheets 34, 36 to extend from the top to the bottom of the sheets 34, 36. The bar seals are equidistantly spaced apart a distance of 1.0625 inch (2.6 cm). A wider bar seal 0.125 inch, (0.31 cm) is formed at the center of the sheets 34, 36 (between the first-described bar seals) to extend from the top to the bottom of the sheets 34, 36. The segmented bar seal 42 and the large solid bar seal 44 are formed. A binding seal 54, approximately 0.9375 inch (2.3 cm) in width, is centered atop the bar seal at the center of the sheets 34, 36 and heat-sealed in place. The binding seal 54 is made of a decorative, heat-sealable reinforcing material. The reinforcing material preferably is commercially available 8-gauge colored vinyl. Such material can be obtained from the American Renolit Corporation of LaPorte, Ind.

At this stage of the manufacturing process, pages 32C and 32D have been formed, with the web 52B connecting the pages 32C, 32D and the binding seal 54 being connected to the web 52B. The pages 32A, 32B and the web 52A are formed in a similar manner to that described above and are superimposed over the pages 32C, 32D, and the web 52B, respectively. The pages 32A, 32B, 32C, 32D are folded atop each other, preferably by using an anvil 56 placed at the center bar seal in the webs 52A, 52B. The folded pages 32A, 32B, 32C, 32D are placed in a box (not shown). The webs 52A, 52B are sealed to each other by forming segments 58 by means of a 0.9375 (2.3 cm) stitch seal bar. Typically, the segments 58 will have a width of about 0.15 inch (0.38 cm) and will be spaced about 0.20 inch (0.5 cm) from adjacent segments 52. The centers of adjacent segments 58 will be spaced about 0.375 inch (0.95 cm) from each other.

If desired, prior to heat-sealing the webs 52A, 52B, a single page 32 such as that shown in FIG. 5 can be inserted between the pages 32A, 32B with its flange 38 inserted into the folded web 52A. Such a construction enables an odd number of pages 32 to be provided. If such a feature is not provided, the menu book 50 will have an even number of pages 32. Another technique for making a menu book is to stack any desired number of single pages 32 as shown in FIG. 5 and heat-seal them to each other with segments 58 as described above for assembly of the menu book 50. In all of the heat-sealing operations discussed herein, the use of a radio frequency transducer is preferred, although other heat-sealing techniques can be employed, if desired.

A menu book in accordance with another embodiment of the invention is indicated in FIGS. 10–13 by the reference numeral 100. The menu book 100 has two outer pages 102 and an inner page 104. Both the outer and inner pages 102, 104 are defined by first and second outer sheets 106 that are separated by a divider sheet 108 to form pockets or sleeves 110. The outer sheets 106 are made of the same material as the sheets 34, 36. The divider sheet 108 is made of similar material, but in 8-gauge thickness and with a coloring or tint to make it translucent or opaque. The pages 102 are connected by a web portion 112. A flange 114 extends along one edge of the page 104. When the web portion 112 is folded upon itself and the flange 114 is inserted therebetween (FIG. 13), the book 100 will be provided with a spine 116. An external reinforcing strip 118 is disposed along the spine 116. The strip 118 is formed of any suitable reinforcing material as known in the art. Preferably, the strip 118 is made of a heat-sealable vinyl material that is commercially available from the American Renolit corporation of LaPorte, Ind.

In a manner similar to the assembly of the embodiment of FIGS. 8 and 9, the sheets 106, 108 are connected to each other by bar seals 120, segmented seals 122, and solid rule heat seals 124. The seals 120, 122, 124 are similar to the seals 40, 42, 44. Additional small heat seals 126 provide additional strength at either side of the entrance to the sleeves 110. The strip 118 is secured to the external portion of the spine 116 by heat-sealing and by a stitch seal bar that produces large segments 128 that are similar in size and shape to the segments 58. If desired, decorative designs or logos 130 (such as trademarks or advertising materials) can be embossed in the sheets 106 about the periphery thereof.

Figure 13:
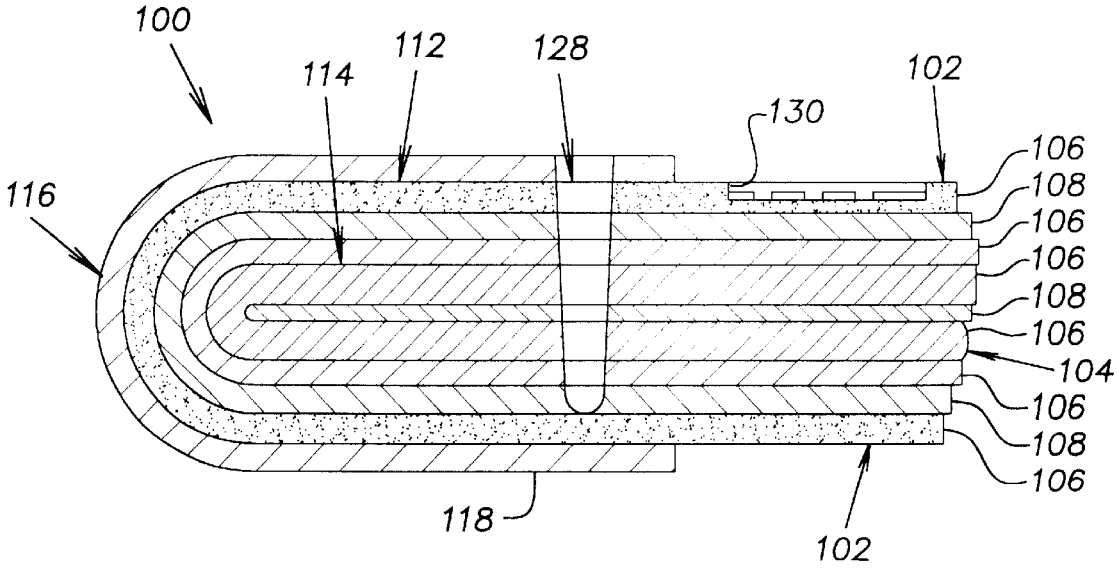
FIG. 13 is a view taken along a plane indicated by line 13—13 in FIG. 10.

Referring now to FIG. 13, the flange portion of the menu page 100 is shown in cross-section.

A menu book produced according to the invention has numerous advantages. It is easy to manufacture because the pages can be manufactured in a simple stamping and heat-sealing operation. Because the flanges and/or webs are heat-sealed to each other, the use of spiral binding coils is eliminated. Unlike prior art spiral-bound menu books, the menu book according to the invention is capable of being stacked with like menu books without concern for the orientation of the menu books. The menu book according to the invention will not snag on clothing and is easy to remove from a stack of similar menu books.

The pages of the menu book according to the invention cannot become separated from each other. This is because either the flanges and/or the webs are fused to each other securely. Due to the use of segmented rule heat seals and the solid rule seams at the corners, the pages have excellent structural integrity and strength. Further, the use of the binding or reinforcing seal adds additional stability and strength to the menu book without adding any significant weight. It has been found that the pages are sufficiently sturdy that there is no need to add stiffener boards or extra heavy menu pages to provide bulk to the pages.

Although the invention has been described in its various forms with a certain degree of particularity, it will be understood that the present disclosure of the invention has been made only by way of example, and that various changes may be resorted to without departing from the true spirit and scope of the invention as hereinafter claimed. It is intended that the patent shall book, by suitable expression in the appended claims, whatever features of patentable novelty exist in the invention disclosed.

What is claimed is:

1. A menu book, comprising:

a plurality of pages, each having:

a sleeve into which menu sheets can be inserted, each sleeve having transparent surfaces through which a menu sheet disposed within the sleeve can be observed;

and a heat-sealable flange along a selected edge;

the pages being superimposed, with the flanges of the pages also being superimposed and disposed adjacent each other; and a heat-sealed connection between the flanges.

2. The menu book of claim 1, wherein the pages are made of textured vinyl.

3. The menu book of claim 1, further comprising a strip of heat-sealable reinforcing material that is wrapped about the flanges and fused to the flanges.

4. The menu book of claim 1, wherein the heat-sealed connection between the flanges is a series of spaced indented segments formed by a stitch seal bar.

5. The menu book of claim 1, wherein:

each page is rectangular with a longer side and a shorter side, the flange projecting from the longer side;

each page comprises a first sheet and a second sheet, the first and second sheets being superimposed, the first and second sheets being joined by a generally U-shaped, heat-sealed seam; and the flange is an integral portion of one or both of the first or second sheets and projects laterally from the heat-sealed seam.

6. The menu book of claim 5, wherein the longer side of the second sheet is shorter than the longer side of the first sheet so as to form an opening for the sleeve.

7. The menu book of claim 5, wherein:

the flanges and the peripheral seams are fused in alternating segments; and the corners of the pages are rounded and fused with a continuous segment.

8. The menu book of claim 1, wherein:

a pair of pages are disposed side-by-side with the flanges of each page being connected to each other to form a web that connects the pages; and the pages are folded toward each other so that the pages are stacked atop each other.

9. The menu book of claim 8, wherein, prior to the pages being folded toward each other, the webs of a plurality of similarly constructed pages are superimposed such that an even number of laterally spaced pages are stacked atop each other after the flanges have been fused.

10. The menu book of claim 8, further comprising a page having a transparent sleeve into which a menu sheet can be inserted, the page having a flexible, heat-sealable flange along a selected edge, the heat-sealable flange being disposed within the folded web and heat-sealed in place there, the assembled menu book having an odd number of pages.

11. The menu book of claim 1, wherein:

each page is rectangular with a longer side and a shorter side, the flange projecting from the longer side;

each page comprises a first sheet, a second sheet, and a divider sheet disposed between the first and second sheets, the three sheets being superimposed and joined by a generally U-shaped, heat-sealed seam to form first and second sleeves; and the flange being an integral part of one or more of the first sheet, the second sheet, and the divider sheet, the flange projecting laterally from the heat-sealed seam.

12. The menu book of claim 11, wherein the divider sheet is translucent or opaque.

13. The menu book of claim 11, wherein the longer side of the first and second sheets is shorter than the longer side of the divider sheet so as to form an opening for the sleeves.

14. The menu book of claim 11, wherein:

the flanges and the peripheral seams are fused in alternating segments; and the corners of the pages are rounded and fused with a continuous segment.

15. The menu book of claim 11, wherein the heat-sealed connection between the flanges is a plurality of spaced indented segments made by a stitch seal bar.

16. The menu book of claim 11, wherein:

a pair of pages are disposed side-by-side with the flanges of each page being connected to each other to form a web that connects the pages; and the pages are folded toward each other so that the pages are stacked atop each other.

17. The menu book of claim 11, wherein, prior to the pages being folded toward each other, the webs of a plurality of similarly constructed pages are superimposed such that an even number of laterally spaced pages are stacked atop each other after the flanges have been fused.

18. The menu book of claim 16, further comprising a rectangular page with a longer side and a shorter side, and a flange projecting from the longer side, and wherein:

the page comprises a first sheet, a second sheet, and a divider sheet disposed between the first and second sheets, the three sheets being superimposed and joined by a generally U-shaped, heat-sealed seam to form first and second sleeves;

the flange is an integral part of one or more of the first sheet, the second sheet, and the divider sheet, the flange projecting laterally from the heat-sealed seam; and the flange is disposed within the folded web and heat-sealed in place there, the assembled menu book having an odd number of pages.

19. A method of manufacturing a menu book for holding menu sheets, comprising the steps of:

providing a plurality of pages, each page having a sleeve into which a menu sheet can be inserted, each sleeve having transparent surfaces through which a menu sheet disposed within the sleeve can be observed, each page having a flexible, heat-sealable flange along a selected edge;

superimposing the pages, with the flanges of the pages also being superimposed and disposed adjacent each other; and heat-sealing the flanges together.

20. The method of claim 19, wherein the pages are comprised of textured vinyl.

21. The method of claim 19, further comprising the steps of providing a strip of heat-sealable reinforcing material, wrapping the strip about the flanges, and heat-sealing the strip and the flanges together.

22. The method of claim 19, wherein the step of heat-sealing is carried out by a radio frequency transducer.

23. The method of claim 19, wherein the step of providing a plurality of pages comprises:

providing a first sheet and a second sheet;

superimposing the first and second sheets;

joining the first and second sheets by forming a generally U-shaped, heat-sealed seam, the seam being positioned such that the flange projects laterally from the heat-sealed seam, and wherein the seam is formed by heat-sealing the flanges and the peripheral seams with a segmented sealing rule; and rounding the corners of the pages and heat-sealing the corners with a solid rule.

24. A method of manufacturing a menu book for holding menu sheets, comprising the steps of:

providing a first sheet of transparent heat-sealable material;

providing a second sheet of transparent heat-sealable material;

superimposing the first and second sheets;

forming first and second laterally spaced pages into which sheets of printed material can be placed, the pages being formed by:

joining the first and second sheets to each other with heat-sealed seams, the seams of the first and second pages that are adjacent to each other being spaced to define a first web therebetween; and forming spaced, parallel bar seals in the web;

folding the pages along the web so that the folded web forms flanges for the pages and the pages are superimposed with the flanges disposed along one side; and heat-sealing the flanges.

25. The method of claim 24, further comprising the step of placing a divider sheet between the first and second sheets prior to the step of forming first and second laterally spaced pages.

26. The method of claim 24, further comprising the steps of:

providing third and fourth sheets of transparent heat-sealable material of substantially the same size and shape as the first and second sheets;

superimposing the third and fourth sheets forming third and forth laterally spaced pages into which sheets of printed material can be placed, the pages being formed by:

joining the third and fourth sheets to each other with heat-sealed seams, the seams of the third and fourth pages that are adjacent to each other being spaced to define a second web therebetween; and forming spaced, parallel bar seals in the second web;

superimposing the first and second webs, the first and third pages, and the second and fourth pages;

folding the pages toward each other along the first and second webs so that the first and second webs are folded to form flanges for the pages and the pages are stacked atop each other; and heat-sealing the flanges together.

27. The method of claim 26, further comprising the step of placing a divider sheet between the third and fourth sheets prior to the step of forming third and fourth laterally spaced pages.

28. The method of claim 24, wherein the material is comprised of textured vinyl.

29. The method of claim 24, further comprising the steps of:

providing a strip of heat-sealable reinforcing material;

placing the strip adjacent the web prior to the step of heat-sealing the web; and heat-sealing the strip and the web together.

30. The method of claim 24, wherein the step of heat-sealing is carried out by a radio frequency transducer.

31. The method of claim 24, wherein the seam is formed by heat-sealing the flanges and the peripheral seams with a segmented rule, and comprising the further steps of rounding the corners of the pages and heat-sealing the corners with a solid rule.

* * * * *